United States Patent [19]

Ylitalo

[11] 4,421,252

[45] Dec. 20, 1983

[54] TOOTHPASTE DISPENSING DEVICE

[76] Inventor: Howard M. Ylitalo, Rte. 2, Box 101, Cokato, Minn. 55321

[21] Appl. No.: 338,260

[22] Filed: Jan. 11, 1982

[51] Int. Cl.[3] ..... B65D 35/28

[52] U.S. Cl. ..... 222/102; 222/105

[58] Field of Search ..... 222/98, 101, 102, 105, 222/95, 106; 251/6

[56] References Cited

U.S. PATENT DOCUMENTS

| | | | |
|---|---|---|---|
| 2,065,825 | 12/1936 | Riederer | 222/102 |
| 2,496,004 | 1/1950 | Geyer | 222/102 |
| 2,549,488 | 4/1951 | Kramer | 222/101 X |
| 2,558,916 | 7/1951 | Snyder | 222/102 |
| 2,578,472 | 12/1951 | Gunnarson | 222/102 |
| 2,678,144 | 5/1954 | Holt | 222/102 |
| 2,679,951 | 6/1954 | Yantzer | 222/102 |
| 3,221,941 | 12/1965 | Lott | 222/102 |
| 3,414,166 | 12/1968 | Martin | 222/102 |
| 3,946,904 | 3/1976 | Mulakala | 222/102 |
| 4,125,206 | 11/1978 | Wilson | 222/101 |

FOREIGN PATENT DOCUMENTS

| | | | |
|---|---|---|---|
| 602639 | 5/1948 | United Kingdom | 222/102 |

*Primary Examiner*—Joseph J. Rolla
*Assistant Examiner*—Kevin P. Shaver
*Attorney, Agent, or Firm*—Leo Gregory

[57] ABSTRACT

A wall mounted toothpaste dispensing device and toothbrush holder, the dispensing device receiving therein the full extent of a tube of toothpaste embodying the use of a plurality of rollers which by external manual operation in desired increments evacuate fully the entire tube and a dispensing attachment is applied to discharge opening of the tube.

5 Claims, 7 Drawing Figures

TOOTHPASTE DISPENSING DEVICE

BACKGROUND OF THE INVENTION

1. Field of the Invention

This invention relates to a wall mounted device receiving a tube of toothpaste and dispensing the same.

2. Description of the Prior Art

Toothpaste dispensing devices are known to be in the prior art, said devices comprising wall mounted housings to receive toothpaste tubes therein and other of said devices are hand-held in dispensing toothpaste.

Devices known in the prior art are complex in structure, the complexity of which appears to be a factor in view of the absence of such devices from popular use.

SUMMARY OF THE INVENTION

The invention herein discloses a relatively simple structure comprising a wall mounted housing to receive a tube of toothpaste, a plurality of cooperating rollers mounted within said housing have cooperative relationship in engaging the closed end of a tube against an inside wall of said housing, said housing supporting the discharge end of said tube and manual means causing said rollers to squeeze said tube for the discharge of a visible increment of toothpaste.

It is an object of this invention to provide an easily operated and a convenient to use device for discharging toothpaste.

It is a more specific object of this invention to provide a wall mounted housing having a plurality of rollers cooperatively mounted therein, said rollers engaging the closed end of a tube of toothpaste disposed in said housing, a discharge cap is applied to the discharge end of said tube and a manually operated handle causes said rollers to travel upon said tube discharging toothpaste therefrom.

It is a further object of this invention to provide a wall mounted housing receiving a tube of toothpaste, a plurality of externally operated rollers in said housing, said rollers having inter-engagement, means in connection with said housing adjusting the tension of said rollers and means in cooperation with said rollers dispensing from said tube visible increments of toothpaste.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
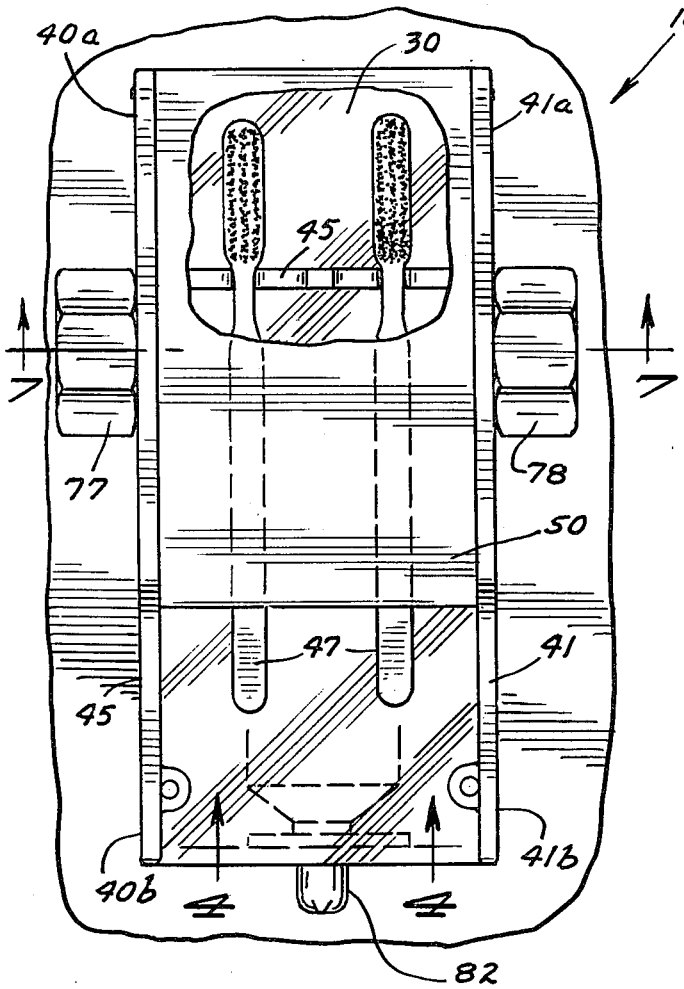
FIG. 1 is a view in front elevation with a portion broken away.
Figure 2:
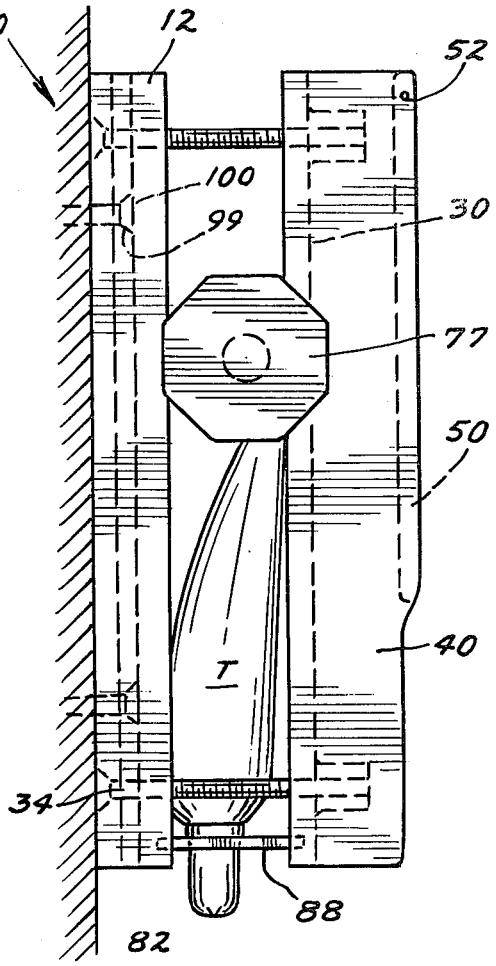
FIG. 2 is a side elevational view.
Figure 3:
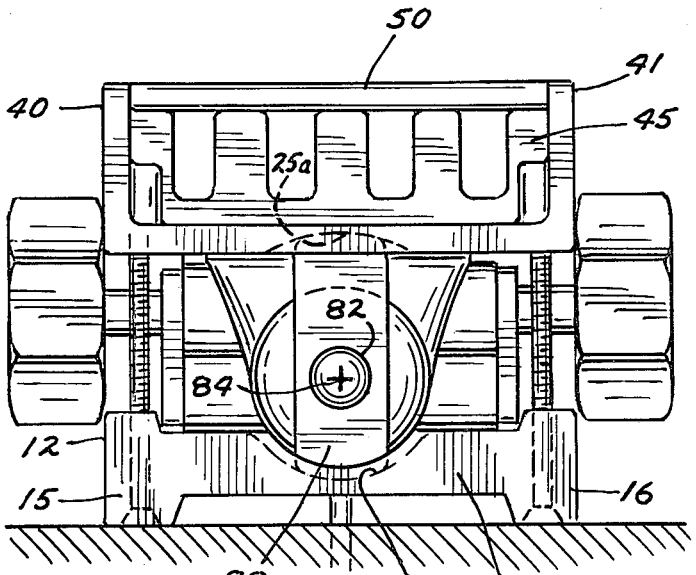
FIG. 3 is a bottom plan view.
Figure 4:
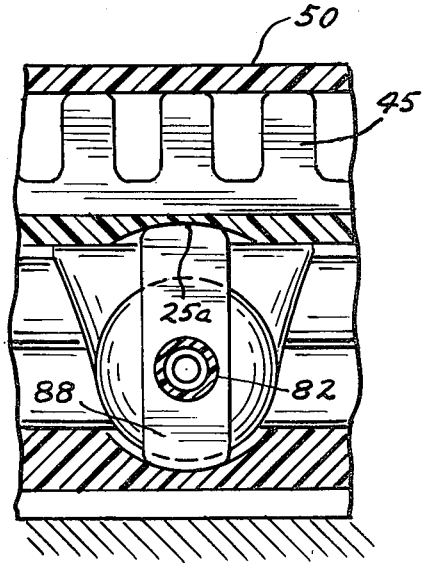
FIG. 4 is a broken view in horizontal section taken on line 4—4 of FIG. 1 as indicated.

With reference to the drawings herein, a toothpaste dispensing device 10 is shown and in the embodiment here presented comprises a back or mounting wall 12 substantially rectangular in plan having a recessed rear surface portion 13 forming rails or ledges 15 and 16 at each side thereof. Said back wall has a top or front recessed surface portion 18 forming rails or ledges 20 and 21 at each side thereof the length thereof.

Centrally longitudinally of said top surface portion 18 is an arcuate groove 23 and adjacent the front end portion of said top surface 18 is a transverse arcuate groove 25.

Spaced from said bottom wall 12 is a top wall 30 coextensive therewith and adjustably spaced therefrom by bolts 34 which extend through said bottom wall as through the apertures 35 and are threaded into said top wall into appropriately formed taps 37. Thus the spacing between said top and bottom walls is adjustable by rotation of said bolts 34. Upstanding from each side of said top wall are side wall 40 and 41 coextensive therewith and respectively having upper end portions 40*a*, 41*a* and lower end portions 40*b*, 41*b*. Spaced from said upper end portion and secured between said side walls as by fusing or by the use of an adhesive is an appropriately slotted shelf 45 particularly adapted to carry toothbrushes such as indicated at 47.

A cover 50 is disposed to overlie the upper portion of said top wall being hingedly secured between the upper portions of said side walls by a hinge pin as indicated at 52. Said wall 50 as a cover member is readily raised for access to the underlying toothbrushes.

Disposed between said upper and lower walls for longitudinal movement therebetween for securing a toothpaste tube and dispensing toothpaste therefrom are dispensing means 60.

Figure 5:
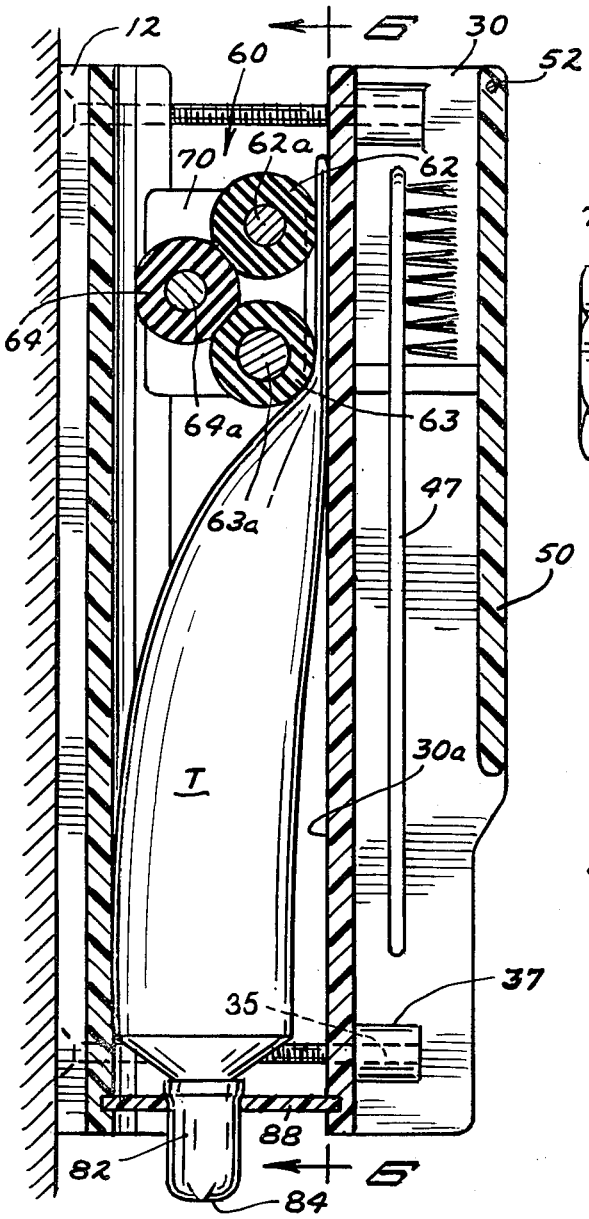
FIG. 5 is a view in vertical cross section.
Figure 6:
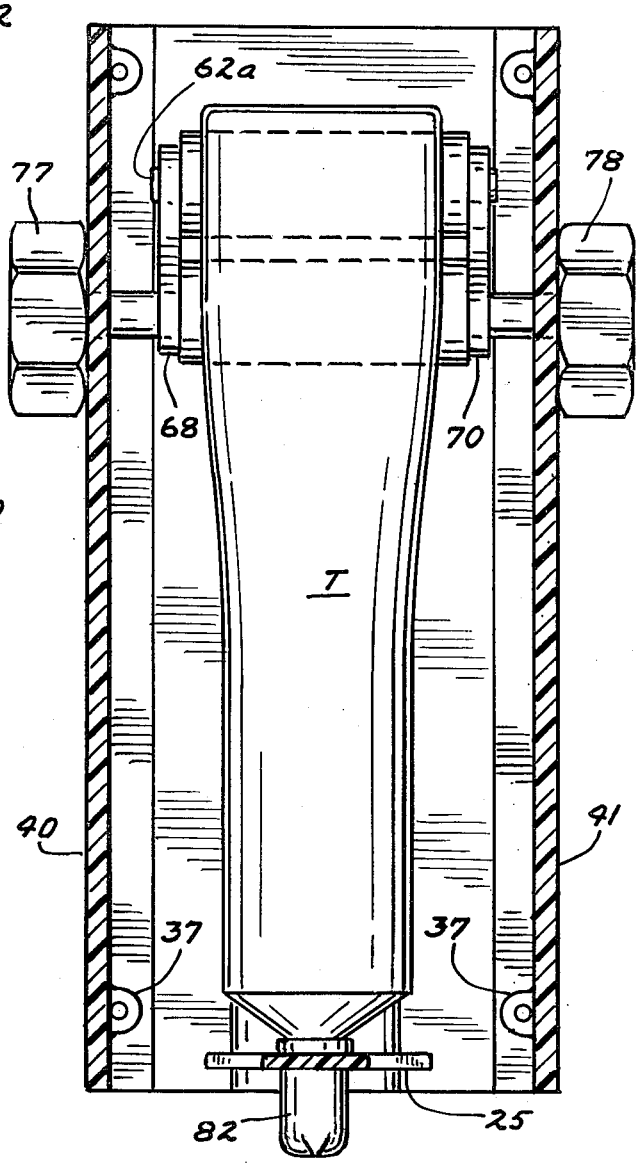
FIG. 6 is a view in vertical section taken on line 6—6 of FIG. 5.

Said dispensing means comprises in the present embodiment three resiliently covered rollers 62, 63 and 64. Said rollers are disposed to be in a triangular formation to have inter-engagement or inter-frictional engagement as indicated in FIG. 5, being respectfully conventionally journaled between side plate members 68 and 70, having roller 64 disposed at the rear thereof and rollers 62 and 63 forwardly thereof, as here shown. Rollers 62 and 64 have shafts 62*a* and 64*a* disposed therethrough to be integral therewith and journaled into said side plate members as indicated at 62*a* in FIG. 6. Extending through the roller 63 is a shaft 63*a* extending beyond the plate members 68 and 70 and have secured to the outer projecting ends thereof manually operable means 77 and 78 here shown as knobs. Said knobs are of a size to permit ready manipulation in dispensing toothpaste. Said knobs may have a serrated outer surface for easy grip or may be formed as polygons as illustrated.

Figure 7:
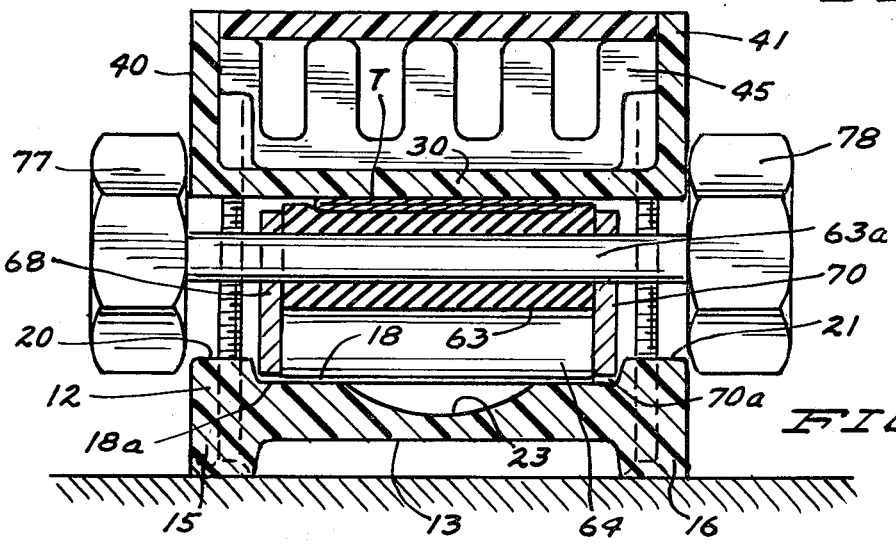
FIG. 7 is a view in horizontal section taken on line 7—7 of FIG. 1 as indicated.

Said side plate members 68 and 70 respectively have their lower wall portions as at 68*a* and 70*a* guided by the adjacent portions of said side rails 20 and 21. The knobs 77 and 78 respectively at their inner sides bear against the upper walls 40 and 41 as indicated in FIG. 7. Thus the dispensing means are kept from becoming cocked. The rollers are under compression between the surface portion 18 of the back wall and the opposed surface of the wall 30. The degree of compression is adjusted by rotation of said screws 34.

A flexible dispensing tip member 82 is provided having a slit outlet end 84 adapted to open under a forward pressure of toothpaste and carried thereon transversely thereof is a rectangular plate member 88 which in being rotated to a vertical position has one end portion received into the arcuate transverse slot 25 formed in the bottom wall 12 and its other end portion is received into a corresponding vertically aligned slot 25*a* formed in the top wall 30. Thus before insertion of the tube into the dispensing device, the cap which is provided with a tube of toothpaste is removed and replaced by the dispensing tip member 82. The back plate member may be conveniently mounted by the screws 100 through the apertures 99 therein.

OPERATION

The dispensing means 60 is moved to the upper end of the device 10, a tube T is disposed between said back and top walls longitudinally thereof and slid along said groove 23 with the inner end of said tube being positioned between the roller 63 and the inner surface 30*a* of the top wall 30 as indicated in FIG. 5. Said tube is pushed inwardly against the resilience of the roller 63 until it is fully inserted and the tube holding plate member 88 is rotated to a vertical position to have its end portions received within the arcuate slots 25 and 25*a*.

The knobs 77 and 78 are then rotated to advance the rollers to progressively squeeze the tube against the adjacent surface of said top wall and toothpaste is dispensed in desired increments. There is no waste of toothpaste as the tube is entirely evacuated. What is claimed is:

1. A toothpaste dispensing device, having in combination a back plate member, an overlying top plate member, means variably spacing said plate members, said back plate member having a pair of side ledges, dispensing means disposed between said plate members, said dispensing means comprising a pair of opposed spaced plate members carried by said back plate member and respectively engaging said side ledges, a plurality of resilient rollers journaled between said plate members, said rollers being in inter-frictional engagement, at least one of said rollers being positioned to engage a tube of toothpaste against said top plate member, a shaft having a portion extending outwardly of one of said ledges from one of said rollers, manual means carried by said extended portion of said shaft rotating said shaft and said rollers, plate means disposed between said plate members receiving and holding dispensing cap for the outlet portion of the dispensing end of a tube of toothpaste, and a pair of opposed grooves receiving end portions of said last mentioned means.

2. A toothpaste dispensing device, having in combination a mounting back plate member, an overlying top plate member spaced from said mounting plate member, adjustable means spacing said plate members, said mounting plate member having a pair of side ledges, dispensing means disposed between said plate members, comprising a pair of opposed upstanding side plate members extending longitudinally of and being carried by said mounting plate and respectively engaging said ledges, a plurality of resilient rollers journaled between said side plate members in a triangular relationship, said rollers having frictional contact with one another, one of said rollers having a shaft extending outwardly of at least one of said side ledges, manual means secured to said outwardly extending shaft rotating said rollers, at least one of said rollers being adjacent said top plate adapted to have the end portion of a tube of toothpaste engaged therebetween, plate means disposable at the front end portions of said plate members engaging a dispensing cap carried by said last mentioned means adapted to be secured to the dispensing outlet of said tube, and said cap having flexible slit outlet portions.

3. The structure of claim 2, wherein said mounting plate member has an arcuate groove centrally longitudinally thereof formed in the upper surface portion thereof.

4. The structure set forth in claim 2, wherein said adjustable means comprises screw members variably spacing said mounting and top plate members relative to each other.

5. The structure set forth in claim 2, including opposed arcuate slots formed in the front end portions of said mounting and top plate members in opposed vertical relation.

* * * * *